US008259139B2

(12) United States Patent
Culbert et al.

(10) Patent No.: US 8,259,139 B2
(45) Date of Patent: Sep. 4, 2012

(54) USE OF ON-CHIP FRAME BUFFER TO IMPROVE LCD RESPONSE TIME BY OVERDRIVING

(75) Inventors: Michael Culbert, Monte Sereno, CA (US); Timothy J. Millet, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 880 days.

(21) Appl. No.: 12/321,639

(22) Filed: Jan. 22, 2009

(65) Prior Publication Data

US 2010/0085290 A1 Apr. 8, 2010

Related U.S. Application Data

(60) Provisional application No. 61/194,994, filed on Oct. 2, 2008.

(51) Int. Cl.
*G09G 5/10* (2006.01)

(52) U.S. Cl. ..... 345/690; 345/89

(58) Field of Classification Search ..... None
See application file for complete search history.

(56) References Cited

U.S. PATENT DOCUMENTS

| | | | |
|---|---|---|---|
| 6,707,439 | B2 | 3/2004 | Ijima et al. |
| 7,034,793 | B2 | 4/2006 | Sekiya et al. |
| 7,304,624 | B2 | 12/2007 | Lee |
| 2002/0044151 | A1 | 4/2002 | Ijima et al. |
| 2002/0175907 | A1 | 11/2002 | Sekiya et al. |
| 2005/0001802 | A1 | 1/2005 | Lee |
| 2006/0290642 | A1 | 12/2006 | Kim et al. |
| 2007/0164949 | A1 | 7/2007 | Lee et al. |
| 2008/0013126 | A1 | 1/2008 | Tseng et al. |
| 2008/0192061 | A1 | 8/2008 | Lim |
| 2009/0079746 | A1 | 3/2009 | Howard et al. |

FOREIGN PATENT DOCUMENTS

| | | | |
|---|---|---|---|
| EP | 1521237 | A2 | 4/2005 |
| JP | Hei 7-334123 | A | 12/1995 |
| JP | 2002108294 | A | 4/2002 |
| JP | 2002351409 | A | 12/2002 |
| KR | 10-2005-0003919 | A | 12/2005 |

OTHER PUBLICATIONS

JPO Machine Translation of JP 7334123 (Dec. 22, 1995), on Dec. 16, 2011.*

Korean Search Report for Korean Application No. 10-2011-7009845 dated May 11, 2011, 10 pgs.

Kobayashi et al.; "Feedback level adaptive overdrive technology applicable to digital hd lc-tvs," Proceedings of the International Display Workshops, Dec. 4, 2002; pp. 323-236.

Korean Preliminary Rejection for Korean Application No. 10-2011-7009845 dated Jul. 4, 2011, 11 pgs. with English translation (5 pgs.).

* cited by examiner

*Primary Examiner* — Paul Huber
(74) *Attorney, Agent, or Firm* — Fletcher Yoder PC

(57) ABSTRACT

A method and system is disclosed for improving the response time of displays, such as liquid crystal displays (LCDs). The method includes receiving a target picture frame and comparing it to a current picture frame. If the comparison shows that a display may be unable to transition from a current pixel intensity level to a target pixel intensity level within a specified time period, then the pixels that correspond to those current pixel intensities that may not be reach target pixel intensities may be overdriven. This overdriving of one or more pixels may allow the pixel to reach the target pixel intensity within the specified time period.

24 Claims, 3 Drawing Sheets

USE OF ON-CHIP FRAME BUFFER TO IMPROVE LCD RESPONSE TIME BY OVERDRIVING

CROSS REFERENCE TO RELATED APPLICATION

This application claims the benefit of U.S. Provisional Application No. 61/194,994, filed Oct. 2, 2008.

BACKGROUND

The present disclosure relates generally to reducing artifacts in a display by dynamically adjusting a signal to the display.

DESCRIPTION OF THE RELATED ART

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid Crystal Displays (LCDs) are widely used as display devices for modern electronics. Typically, LCD's include an array of pixels that may be illuminated to generate a set of images. The response time of an LCD may measure the time it takes the liquid crystals that form each pixel to transition from a present intensity level to a new target intensity level. For example, the response time may be the time required for an LCD pixel to change from fully active (black) to fully inactive (white), or from fully active to fully inactive and then back to fully active again. Response time is important with respect to LCD's because if the response time of the display is too slow, the pixels may be unable to keep up with the information transmitted to the pixels, which can result in digital noise displayed or ghosting on the LCD. Tied to the response time of an LCD is the refresh period of the LCD, which defines how often the display is instructed to change the displayed image. In certain instances, however, the response time of an LCD can exceed its refresh period. In these cases, the LCD may display screen artifacts that users may find undesirable. Accordingly, there is a need for techniques that can accelerate the response time of an LCD.

SUMMARY

Certain aspects of embodiments disclosed herein by way of example are summarized below. It should be understood that these aspects are presented merely to provide the reader with a brief summary of certain embodiments and that these aspects are not intended to limit the scope of the claims. Indeed, the disclosure and claims may encompass a variety of aspects that may not be set forth below.

An electronic device having signal adjusting circuitry is provided. In one embodiment, the signal adjusting circuitry may be used to adjust a signal being sent to one or more pixels of an LCD. The signal adjusting circuitry may determine that a given target pixel intensity for a particular pixel location of a target picture frame may be difficult to achieve on the LCD during a given frame refresh period. This determination may be based on the current pixel intensity being displayed on the LCD and/or the target pixel intensity. When this occurs, the signal adjusting circuitry may adjust the target pixel level for a given pixel location and send the adjusted signal to an LCD driver to cause it to overdrive the target pixel for one or more frame periods. Although overdriving the target pixel will typically not cause the intensities of the pixel to reach the adjusted target level, it typically will cause the intensities of the pixel to reach the originally given target level.

The signal adjusting circuitry may include a lookup table used to store the overdrive levels used to achieve a target pixel intensity. The signal adjusting circuitry may access the lookup table and adjust the target pixel level for any given pixel location before sending the adjusted signal to the LCD driver. Based on the level selected from the lookup level, and the actual pixel intensity from the previous picture frame, the signal adjusting circuitry may attempt to drive a particular pixel location to an adjusted intensity level. The lookup table may also include information as to what intensity the pixel location will ultimately reach during one frame period, when overdriven at a certain intensity level. The signal adjusting circuitry may store the pixel levels that will be achieved and displayed on the LCD while sending the adjusted picture frame to the video controller for display on the LCD.

BRIEF DESCRIPTION OF THE DRAWINGS

These and other features, aspects, and advantages of the present disclosure will become better understood when the following detailed description of certain exemplary embodiments is read with reference to the accompanying drawings in which like characters represent like parts throughout the drawings, wherein.

DETAILED DESCRIPTION OF SPECIFIC EMBODIMENTS

One or more specific embodiments will be described below. In an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
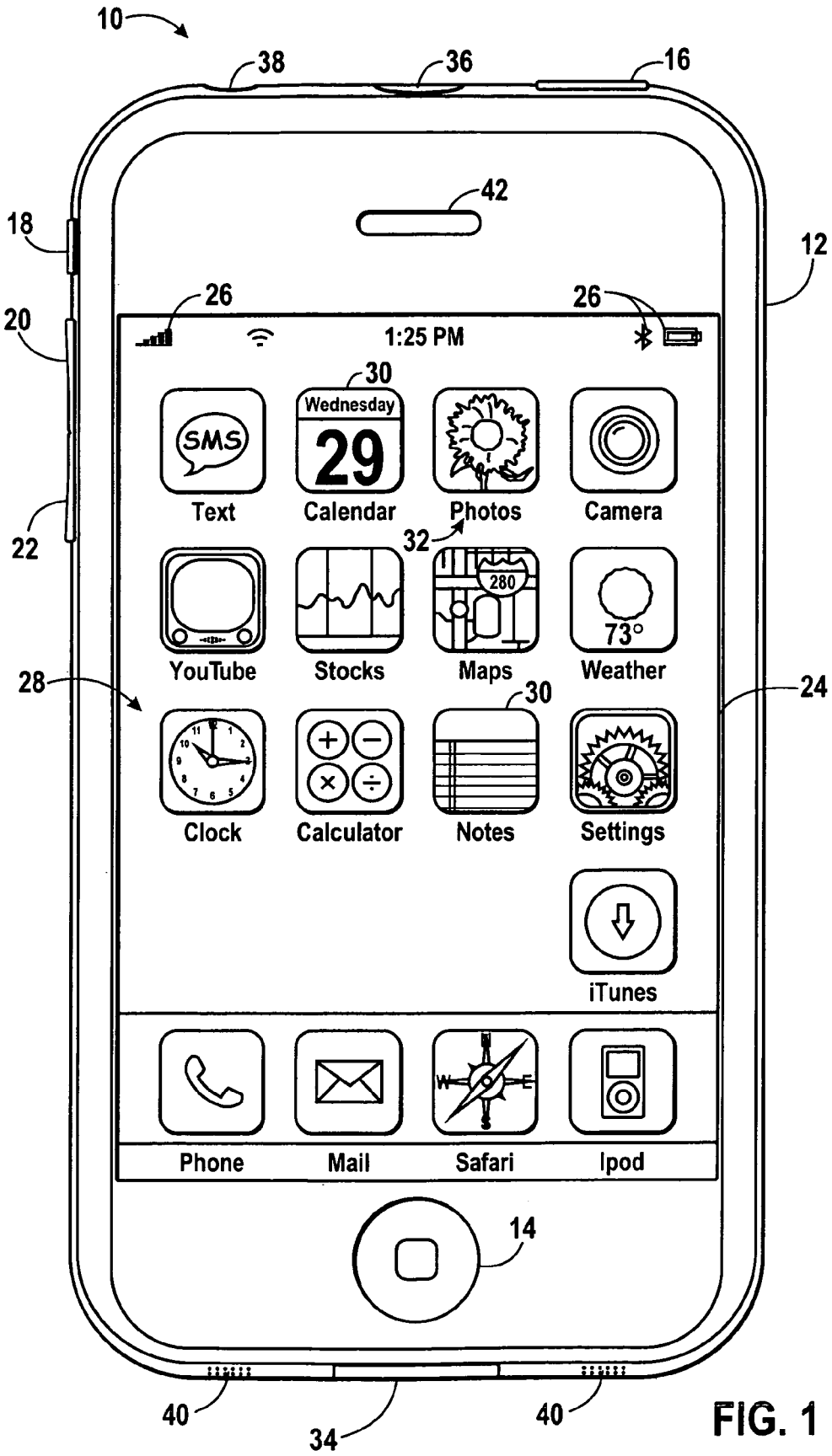
FIG. 1 is a perspective view illustrating an example of an electronic device, such as a portable media player, in accordance with one embodiment.

Turning now to the figures, FIG. 1 illustrates an electronic device 10 that may be a handheld device incorporating the functionality of one or more portable devices, such as a media player, a cellular phone, a personal data organizer, and so forth. Depending, of course, on the functionalities provided by the electronic device 10, a user may listen to music, play games, record video, take pictures, and place telephone calls, while moving freely with the device 10. In addition, the electronic device 10 may allow a user to connect to and communicate through the Internet or through other networks, such as local or wide area networks. For example, the electronic device 10 may allow a user to communicate using e-mail, text messaging, instant messaging, or other forms of electronic communication. The electronic device 10 also may communicate with other devices using short-range connections, such as Bluetooth and near field communication. By way of example, the electronic device 10 may be a model of an iphone® available from Apple Inc. of Cupertino, Calif.

In the depicted embodiment, the device 10 includes an enclosure 12 that protects the interior components from physical damage and shields them from electromagnetic interference. The enclosure 12 may be formed from any suitable material such as plastic, metal, or a composite material and may allow certain frequencies of electromagnetic radiation to pass through to wireless communication circuitry within the device 10 to facilitate wireless communication.

The enclosure 12 allows access to user input structures 14, 16,18, 20, and 22 through which a user may interface with the device. Each user input structure 14,16,18, 20, and 22 may be configured to control a device function when actuated. For example, the input structure 14 may include a button that when pressed causes a "home" screen or menu to be displayed on the device. The input structure 16 may include a button for toggling the device 10 between a sleep mode and a wake mode. The input structure 18 may include a two-position slider that silences a ringer for the cell phone application. The input structures 20 and 22 may include buttons for increasing and decreasing the volume output of the device 10. In general, the electronic device 10 may include any number of user input structures existing in various forms including buttons, switches, control pads, keys, knobs, scroll wheels, or other suitable forms.

The device 10 also includes a display 24 which may display various images generated by the device. For example, the display 24 may show photos, movies, album art, and/or data, such as text documents, spreadsheets, text messages, and email, among other things. The display 24 also may display system indicators 26 that provide feedback to a user, such as power status, signal strength, call status, external device connection, and the like. The display 24 may be any type of display such as a liquid crystal display (LCD), a light emitting diode (LED) display, an organic light emitting diode (OLED) display, or other suitable display. Additionally, the display 24 may include a touch-sensitive element, such as a touch screen.

The display 24 may be used to display a graphic user interface (GUI) 28 that allows a user to interact with the device. The GUI 28 may include various layers, windows, screens, templates, elements, or other components that may be displayed in all, or a portion, of the display 24. Generally, the GUI 28 may include graphical elements that represent applications and functions of the device 10. The graphical elements may include icons and other images representing buttons, sliders, menu bars, and the like. In certain embodiments, the user input structure 14 may be used to display a home screen of the GUI 28. For example, in response to actuation of the input structure 14, the device may display graphical elements, shown here as icons 30, of the GUI 28. The icons 30 may correspond to various applications of the device 10 that may open upon selection of an icon 30. The icons 30 may be selected via a touch screen included in the display 24, or may be selected by user input structures, such as a wheel or button.

The icons 30 may represent various layers, windows, screens, templates, elements, or other components that may be displayed in some or all of the areas of the display 24 upon selection by the user. Furthermore, selection of an icon 30 may lead to a hierarchical navigation process, such that selection of an icon 30 leads to a screen that includes one or more additional icons or other GUI elements. Textual indicators 32 may be displayed on or near the icons 30 to facilitate user interpretation of each icon 30. It should be appreciated that the GUI 30 may include various components arranged in hierarchical and/or non-hierarchical structures.

When an icon 30 is selected, the device 10 may be configured to open an application associated with that icon and display a corresponding screen. For example, when the Weather icon 30 is selected, the device 10 may be configured to open a weather application with a user interface that may provide the current weather conditions to a user. Indeed, for each icon 30, a corresponding application that may include various GUI elements may be opened and displayed on the display 24.

The electronic device 10 also may include various input and output (I/O) ports 34, 36, and 38 that allow connection of the device 10 to external devices. For example, the I/O port 34 may be a connection port for transmitting and receiving data files, such as media files. Furthermore, the I/O port 34 may be a proprietary port from Apple Inc. The I/O port 36 may be a connection slot for receiving a subscriber identify module (SIM) card. The I/O port 38 may be a headphone jack for connecting audio headphones. In other embodiments, the device 10 may include any number of I/O ports configured to connect to a variety of external devices, including but not limited to a power source, a printer, and a computer. In other embodiments, multiple ports may be included on a device. Additionally, the ports may be any interface type, such as a universal serial bus (USB) port, serial connection port, Firewire port, IEEE-1394 port, or AC/DC power connection port.

The electronic device 10 may also include various audio input and output structures 40 and 42. For example, the audio input structures 40 may include one or more microphones for receiving voice data from a user. The audio output structures 42 may include one or more speakers for outputting audio data, such as data received by the device 10 over a cellular network. Together, the audio input and output structures 40 and 42 may operate to provide telephone functionality. Further, in some embodiments, the audio input structures 40 may include one or more integrated speakers serving as audio output structures for audio data stored on the device 10. For example, the integrated speakers may be used to play music stored in the device 10. Additional details of the illustrative device 10 may be better understood through reference to FIG. 2, which is a block diagram illustrating various components and features of the device 10 in accordance with one embodiment.

Figure 2:
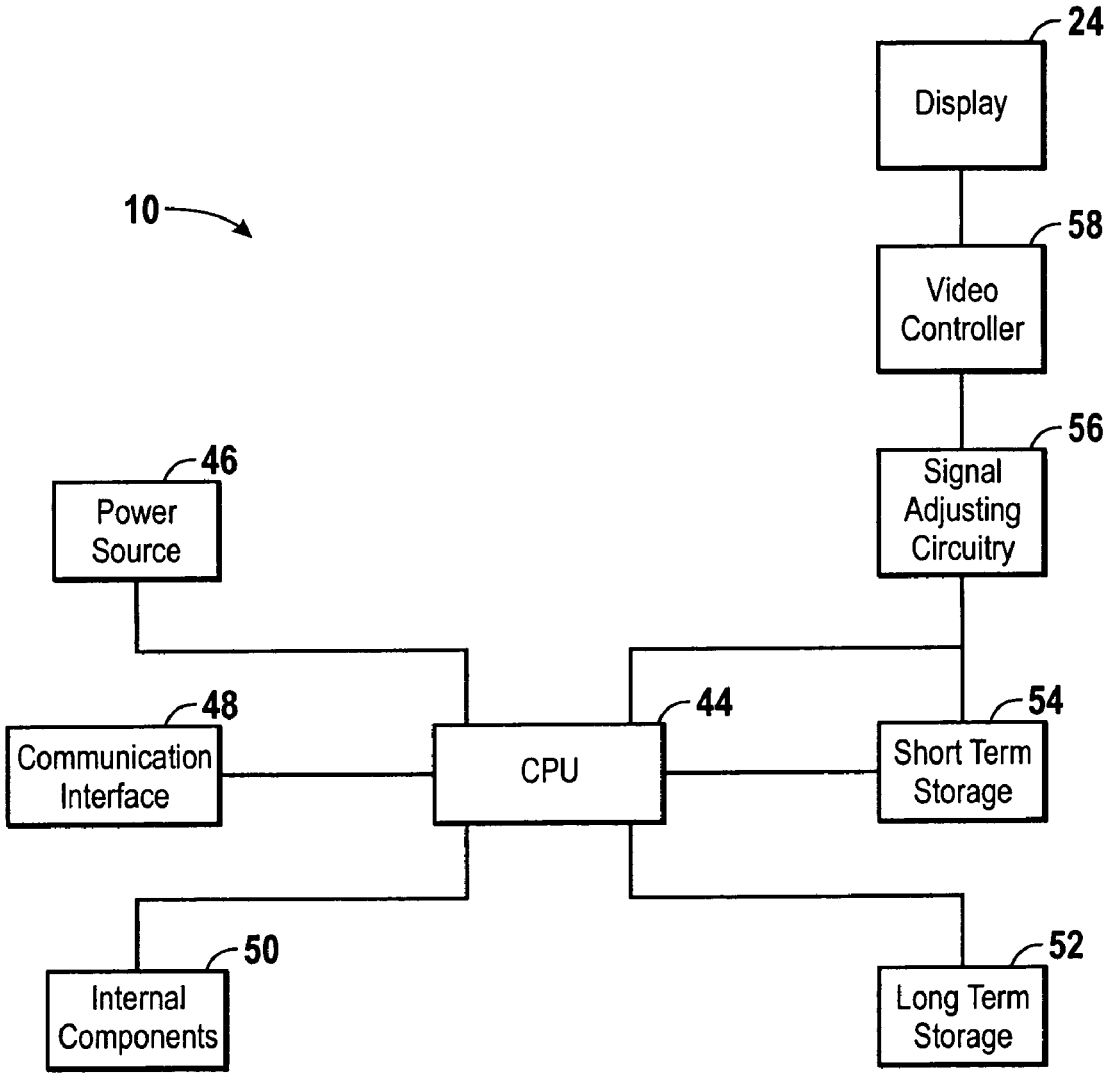
FIG. 2 is a simplified block diagram of the electronic device of FIG. 1 in accordance with one embodiment.

FIG. 2 is a block diagram that illustrates the components that may be utilized by the electronic device 10 to operate. In the presently illustrated embodiment, the device 10 may include the elements described in reference to FIG. 1, such as the display 24. In addition, as discussed in greater detail below, the electronic device 10 may include includes a central processing unit (CPU) 44, a power source 46, a communications interface 48, internal components 50, long-term storage 52, short term storage 54, signal adjusting circuitry 56, and a video controller 58.

As set forth above, the electronic device 10 may include a CPU 44. The CPU 44 may include a single processor or it may include a plurality of processors. For example, The CPU 44 may also include one or more "general-purpose" microprocessors, a combination of general and special purpose microprocessors, and/or ASICS, as well as one or more reduced instruction set (RISC) processors, graphics processors, video processors, and/or related chip sets. The CPU 44 may provide the processing capability to execute the operating system, programs, the GUI 28, and any other functions of the device 10.

The electronic device 10 also may include a power source 46. The power source 46 may be used to power the electronic device 10 via, for example, one or more batteries, such as a Li-Ion battery, which may be user-removable or secured to the enclosure 12 and, which may be rechargeable. Additionally, the power source 46 may be connected to an I/O port that alternately allows for the power source 46 to receive power from an external AC or a DC power source, such as an electrical outlet or a car cigarette lighting mechanism.

The electronic device 10 may further include a communication interface 48. The communication interface 48 may include one or more connectivity channels for receiving and transmitting information between the device 10 and, for example, an external network. For example, the device 10 may connect to a personal computer via the communication interface to send and receive data files, such as media files. The communication interface 48 may represent, for example, one or more network interface cards (NIC) and/or a network controller, as well as associated communication protocols. The communication interface 48 may also include several types of interfaces, including but not limited to, a local area network (LAN) interface for connection to, for example, a wired Ethernet-based network wireless or a wireless LAN, such as an IEEE 802.11x wireless network, a wide area network (WAN) interface for connection to, for example, a cellular data network, such as the Enhanced Data rates for GSM Evolution (EDGE) network or the 3G network, and/or a personal area network (PAN) interface for connection to, for example, a Bluetooth®) network. Use of these interfaces may allow the device 10 to, for example, make and receive phone calls, access the internet, and/or transmit and receive real-time text messages.

The electronic device 10 may also include internal components 50. The internal components 50 may include sub-circuits that perform specialized functions of the electronic device 10. These internal components 50 may include phone circuitry, camera circuitry, video circuitry, and audio circuitry. The phone circuitry may allow a user to receive or make a telephone call through user interaction with the audio input and output structures 40 and 42. The camera circuitry may allow a user to take digital photographs. Additionally, the video circuitry and the audio circuitry may be used to encode and decode video samples taken by the user in conjunction with the camera circuitry or downloaded from an external source such as the internet, as well as allow for the playing of audio files such as compressed music files, respectively.

The electronic device 10 may further long term storage 52. The long-term storage 52 of electronic device 10 may be used for storing data utilized for the operation of the CPU 44, as well as other components of the device 10, such as the communications interface 48 and/or the internal components 50. For example, the long term storage 52 may store the firmware for the electronic device 10 usable by the CPU 44, such as an operating system, other programs that enable various functions of the electronic device 10, user interface functions, and/or processor functions. Additionally, the long term storage 52 may store data files such as media (e.g., music and video files), image data, software, preference information (e.g., media playback preferences), wireless connection information (e.g., information that may enable the device 10 to establish a wireless connection, such as a telephone connection), subscription information (e.g., information that maintains a record of podcasts, television shows or other media to which a user subscribes), telephone information (e.g., telephone numbers), and any other suitable data. The long term storage 52 may be non-volatile memory such as read only memory (ROM), flash memory, a hard drive, or any other suitable optical, magnetic, or solid-state storage medium, as well as a combination thereof.

In addition to the long term storage 52, the device 10 may include short term storage 54. The short term storage 54 may include volatile memory, such as random access memory (RAM), and may be used to store a variety of information. For example, the CPU 44 may use the short term storage 54 for buffering or caching data during operation of the device 10. Additionally, the short term storage 54 may be used to store image data that is to be displayed on the display 24. This image data may be retrieved, for example, by the CPU 44 and/or the signal adjusting circuitry 56 of the electronic device 10.

As described above, the signal adjusting circuitry 56 of electronic device 10 may be utilized to retrieve image data from the short term memory 54. This image data may include pixel intensity levels to be sent to the video controller 58, for translation into voltages used to create images on the display 24. The signal adjusting circuitry 56 may determine if one or more pixel intensity levels in the image data corresponds to a voltage that is beyond the capability of the display 24 to achieve during a single frame. If any of the pixel intensity levels correspond to a voltage level unachievable by display 24, the signal adjusting circuitry may adjust the pixel intensity level transmitted to the video controller 58 to a higher level. While the adjusted intensity level also may not be reached by the display 24, the display 24 may reach, or come close to reaching, the original pixel intensity level.

The signal adjusting circuitry 56 that may be utilized in performing the above process may be an application specific integrated circuit (ASIC), or any other circuitry configured to adjust image data to be sent to the video controller 58. Moreover, while the above process includes the signal adjusting circuitry 56 actively retrieving the image data, thus freeing the CPU 44 to engage in various other tasks, in another embodiment, the signal adjusting circuitry 56 may receive the image data directly from the CPU 44. Furthermore, any other device capable of processing image data, such as a video card, may transmit the image data to either the signal adjusting circuitry 56 directly, or to the short term storage 54. Additionally, the CPU 44 may instead retrieve the image data from a device capable of processing image data, as well as from the communication interface 48, from one or more of the internal components 50, and/or from the long-term storage 52 prior to transmitting send the image data to the signal adjusting circuitry 56 for possible adjustments to any pixel intensity levels.

Additionally, as described above, the electronic device 10 may include a video controller 58 that operates to generate images on the display 24 of the electronic device 10. The video controller 58 may be a device that receives pixel intensity levels from the signal adjusting circuitry 56 and may transmit voltage signals corresponding to those pixel intensity levels to the display 24. The pixel intensity levels may be, for example, numerical levels that correspond to respective pixel intensities to be shown on the display 24. The display 24 may thus receive the voltage signals from the video controller 58 as input signals, and may produce an image corresponding to the received voltage signals. For example, the display 24 may be a liquid crystal display (LCD), which may include the use of a liquid crystal substance disposed between two substrates with electrodes residing on or in the substrates. A voltage signal from the video controller 58 may be applied to the electrodes, thereby creating an electric field across the liquid crystals. The liquid crystals may change in alignment in response to the electric field, thus modifying the amount of light that may be transmitted through the liquid crystal substance and viewed at a specified pixel. In this manner, and through the use of various color filters to create colored subpixels, color images may be represented on across individual pixels of the LCD in a pixilated manner.

Figure 3:
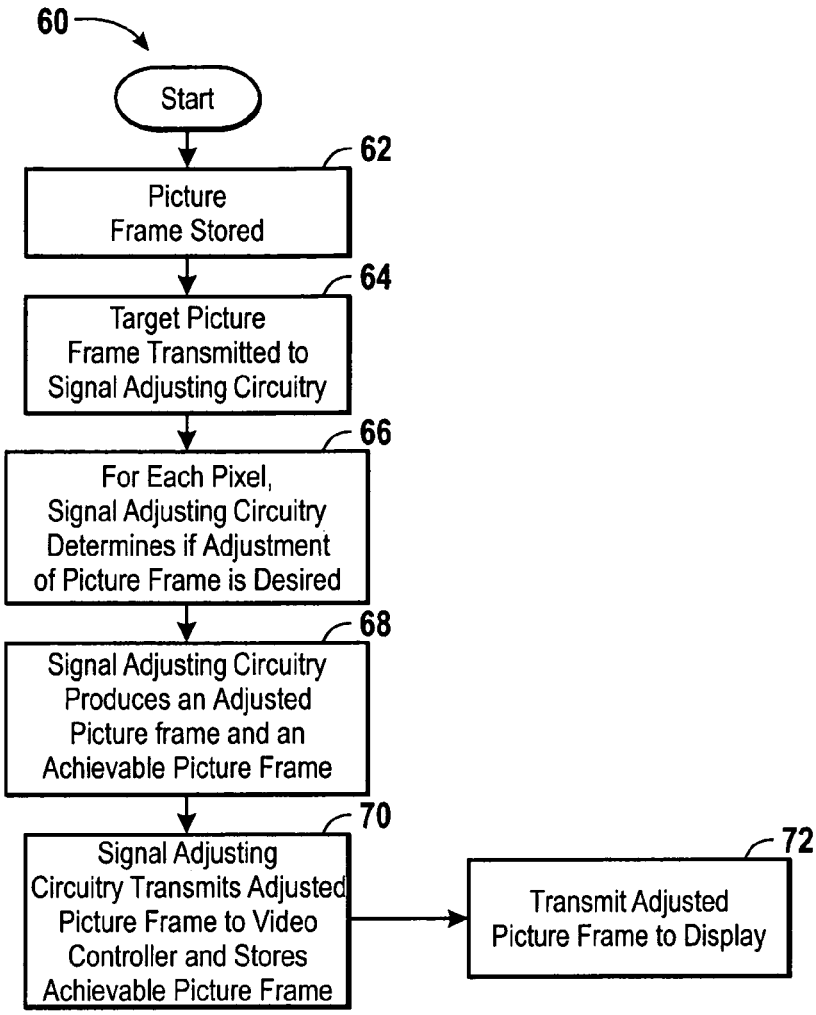
FIG. 3 is a flowchart depicting an example of the operation of the electronic device of FIG. 1 in overdriving a display in accordance with one embodiment.

In operation, the signal adjusting circuit 56 may perform a method 60 for overdriving the display 24 as illustrated by the flowchart of FIG. 3. The method 60 may occur during a single frame, which may be a regular interval at which the display 24 produces or refreshes an image. For example, if the display 24 is set to produce images at 60 Hz, then each frame may occur every 1/60 of a second. However, the present method is not limited to displays set at this speed, and any other speed suitable for displaying images is also contemplated.

The method 60 begins in step 62 when a target picture frame is stored. A target picture frame may contain image data, such as pixel levels, that correspond to a picture image or video image to be displayed. The storage may be any device capable of storing image data such as the long term storage 52 or the short term storage 54. In an embodiment, the target picture frame may be generated by one or more of the internal components 50, such as video circuitry in the electronic device 10, and then transmitted to storage, such as the short term storage 54, prior to display of the target picture frame on the display 24.

In step 64, the target picture frame is transmitted to the signal adjusting circuitry 56. In one embodiment, a video processing device may be utilized to retrieve the target picture frame and transmit the target picture frame to the signal adjusting circuitry 56. For example, the video processing device may be the CPU 44, or may be any other device capable of processing image or video data such as a video processor or a DMA controller. In another embodiment, the functions performed by the video processing device may instead be performed entirely by the signal adjusting circuitry 56. For example, the signal adjusting circuitry 56 may be configured to actively retrieve the target picture frame from short term storage 54, or from any other device capable of generating and/or storing the target picture frame. In yet another embodiment, the video processing device may not be aware of the signal adjusting circuitry 56. For example, the video processing device may transmit the target picture frame along a path to the video controller 58. During transmission, the signal adjusting circuitry 56 may intercept the target picture, and may modify the target picture frame as required, before forwarding the target picture frame to the video controller 58.

In step 66, the signal adjusting circuitry 56 may examine each pixel intensity level in the target picture frame and determine whether adjustment for any pixel intensity levels is desired. An adjustment may be desired, for example, if the display 24 cannot successfully transition, within one frame, from a current pixel intensity level to a target pixel intensity level of the target picture frame. For example, while a given pixel in the display 24 may be able to transition from the color black to the color white in 25 ms, moving from one shade of grey to another shade of grey at a given pixel may take hundreds of milliseconds to complete. Thus, although the display 24 may be refreshed at 60 Hz, moving from, for example, one grey shade to another may only be accomplished at 25-30 Hz, leading to smearing of the images on the display 24. Accordingly, the signal adjusting circuitry 56 may overdrive each pixel, which may allow transitions from one pixel intensity level to another to occur more rapidly. Overdriving a pixel may be a process whereby a pixel is driven past a target pixel intensity level in order to achieve an actual pixel intensity level at or near the target pixel intensity level within a specified amount of time, i.e., one frame. Thus, while the overdriven pixel may fall short of reaching the overdriven pixel intensity level in a specified amount of time, the actual pixel intensity level reached when the pixel is overdriven may be equal to the original target pixel intensity level. In this manner, through overdriving techniques, the signal adjusting circuitry 56 may achieve the original target pixel intensity level specified in the received picture frame. Thus, the signal adjusting circuitry 56 may determine when to overdrive a particular pixel, as well as how much to overdrive a given pixel to achieve an actual pixel intensity level within a given time constraint, such as one frame. Furthermore, the decision as to when to overdrive a pixel as well as how much to overdrive a pixel may be made using a lookup table that provides adjusted pixel levels, or may be made by incorporating any other suitable algorithm or method.

In step 68, the signal adjusting circuitry 56 produces an adjusted picture frame and an achievable picture frame. An adjusted picture frame may contain adjusted pixel levels to be transmitted video controller 58 for overdriving pixels in display 24. However, even with overdriving the pixels of the display 24, on occasion the pixels may not be able to achieve the target picture frame within a set time. For example, a pixel location may be overdriven for two or more frames before the target pixel intensity level is reached. Thus, an achievable picture frame may be determined by the signal adjusting circuitry 56 that contains the achievable pixel intensity levels that the display 24 may actually produce in one frame after application of the adjusted picture frame. In such a scenario, the target picture frame, the adjusted picture, and the achievable picture may be different picture frames containing different pixel levels.

However, it should be noted that between the target picture frame, the adjusted picture frame, and the achievable picture frame, there may be certain instances where some or all of these picture frames are equivalent. For example, if between frames an image remains unchanged, then no adjustment is needed, and the above-mentioned picture frames will all be equivalent. The same is true in instances where the display 24 can successfully transition to the target picture frame within one frame. Also by way of example, if the display 24, only after applying an adjusted picture frame, can successfully transition to the target picture frame within one frame, then the target picture frame and the achievable picture frame will be equivalent to each other, but different from the adjusted picture frame.

In step 70, after making any adjustments to the target picture frame in generating an adjusted picture frame, the signal adjusting circuitry 56 may send the adjusted picture frame to the video controller 58. Additionally, the signal adjusting circuitry 56 may store the achievable picture frame for comparison against the next target picture frame corresponding to the next frame. Finally, in step 72, the video controller 58 may send voltage signals corresponding to the data contained in the adjusted picture frame to the display 24 for generation of an image.

Figure 4:
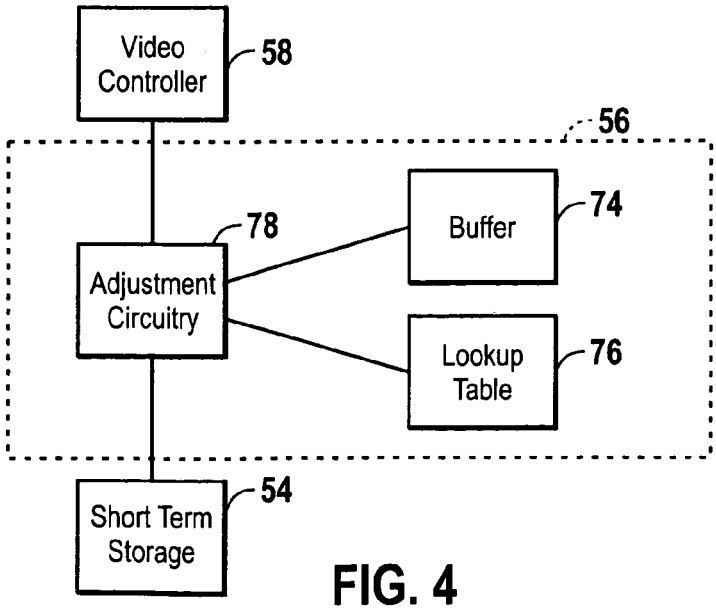
FIG. 4 is a simplified block diagram of the signal adjusting circuitry of FIG. 2 in accordance with one embodiment.

Additional details of the signal adjusting circuitry 56 may be better understood through reference to FIG. 4, which illustrates a simple block diagram of certain components of the signal adjusting circuitry 56. The signal adjusting circuitry 56 may be a LCD driver circuit that processes image data for display on the display 24. The signal adjusting circuitry 56 may also be connected to short term storage 54 and may retrieve the image data therefrom. Furthermore, the signal adjusting circuitry 56 may be coupled to the video controller 58 for transmission of picture frames to be displayed on the display 24. While the signal adjusting circuitry 56 has been illustrated in FIG. 4 as separate from the video controller 58, in some embodiments, the signal adjusting circuitry 56 and the video controller 58 may be part of, for example, a single ASIC. In the illustrated embodiment, the signal adjusting circuitry 56 may also comprise a buffer 74, a lookup table 76, and adjustment circuitry 78, which may also be part of a single ASIC.

The buffer 74 of the signal adjusting circuitry may be used to temporary store data, such as a picture frame from a particular frame. For example, the buffer 74 may store a previous picture frame from a previous frame that may be updatable with an achievable picture frame from a current frame. In one embodiment, the buffer 74 may have the capacity to store one picture frame. Additionally, the buffer 74 may be located in the short term storage 54, or in any other area or device capable of temporarily storing a picture frame or image data.

The signal adjusting circuitry 56 may also include a lookup table 76. The lookup table 76 may hold current pixel intensity levels, target pixel intensity levels, and overdrive pixel intensity levels that may allow target pixel intensity levels of a target picture frame to be reached in one or more frames. These levels stored in the lookup table may depend on the ability of the display 24 to transition, in one frame, from previous pixel intensities of a current picture frame to target pixel intensities of a target picture frame to be displayed. In one embodiment, the lookup table 76 may contain current pixel intensity levels, target pixel intensity levels, and overdrive pixel intensity levels for a generic display 14 that is compatible with device 10. In another embodiment, the lookup table 76 may contain pixel levels respective to various models and manufacturers of displays 14, such that each model may have its own set of adjusted pixel levels and achievable pixel levels. In another yet another embodiment, the lookup table 76 may contain pixel levels specific to the actual display 24 currently in the device 10. Furthermore, it should also be noted that alternative embodiments of the present invention may use an algorithm, curve, or any other formula instead of a lookup table to obtain adjusted pixel levels and achievable pixel levels, which may also still be dependent on the model or manufacturer of the display 14. In addition, in one embodiment, the lookup table 76 may be located within the signal adjusting circuitry 56, as depicted in FIG. 4. In alternative embodiments, the lookup table 76 may be located in any other device capable of storing data such as the short term storage 54, or in any other area or device capable of temporarily storing a picture frame or image data.

The signal adjusting circuitry 56 may further include adjustment circuitry 78. The adjustment circuitry 78 may receive a target picture frame, as well as retrieve a current picture frame stored in the buffer 74. Based on the two picture frames, the adjustment circuitry 78 may access the lookup table 76 to determine whether adjustment for any pixel intensity levels is desired, as well as the overdrive level that will allow the target pixel intensity level to be reached. An adjustment may be desired, for example, if the display 24 cannot successfully transition, within one frame, from a current pixel intensity level to a target pixel intensity level of the target picture frame. The adjustment circuitry 78 may then, based on the overdrive levels from the lookup table 76, transmit adjusted pixel intensity levels to the video controller 58 in order to achieve actual pixel intensity levels at or near the target pixel intensity levels within a specified amount of time, i.e., one frame. The adjustment circuitry 78 may also overwrite the picture frame in the buffer 74 with a picture frame corresponding to the actual pixel intensity levels that will be achieved, based on the adjusted pixel intensity levels transmitted to the video controller 58.

It should be noted that for a particular picture frame transition to a target picture frame, some, none or all of the pixel intensity levels may be adjusted. As such, in certain instances, some pixel intensity levels may remain the same (i.e. when the target pixel intensity level is equivalent to the current pixel intensity level), some pixels may be able transition to target pixel intensity levels without any adjustment (i.e. driving the pixel to the target pixel intensity level is achieved within a single frame by transmitting a pixel intensity level equal to the target pixel intensity level), and some pixels may use adjusted pixel intensity levels to successfully transition to the target pixel intensity level intensity in one frame (i.e. driving the pixel to the target pixel intensity level is achieved within a single frame by overdriving the pixel with a pixel intensity level that exceeds the target pixel intensity level).

Furthermore, some pixels, even when overdriven, may not reach the target pixel intensity level in a single frame because achievable pixel intensity levels may not depend on the absolute range of transition from a current pixel intensity level to a target intensity pixel level. This is because transitions from one pixel intensity may be more difficult to make than transitions from a second pixel intensity. Accordingly, when a pixel may not reach the target pixel intensity level in a single frame, the adjustment circuitry 78 may drive the pixel to the target pixel intensity level by overdriving the pixel with a pixel intensity level that exceeds the target pixel intensity level in a first frame, and subsequently driving or overdriving the pixel to the target pixel intensity level in one or more subsequent frames, until the target pixel intensity level is reached or until a new target pixel intensity is established in a subsequently received target picture frame.

Specific embodiments have been shown by way of example in the drawings and have been described in detail herein. However, it should be understood that the claims are not intended to be limited to the particular forms disclosed. Rather, the claims are to cover all modifications, equivalents, and alternatives falling within their spirit and scope.

What is claimed is:

1. A method for overdriving a display, comprising:

receiving a target picture frame that corresponds to target pixel intensity levels to be displayed on a display for each of the plurality of pixels of the display;

comparing the target picture frame with a current picture frame that corresponds to current pixel intensity levels currently displayed on the display for each of a plurality of pixels of the display;

determining adjustments to be made to the target picture frame based on a comparison of the target picture frame and the current picture frame; and generating an adjusted picture frame comprising the adjustments determined to be made to the target picture frame by overdriving the plurality of pixels to overdrive pixel intensity levels that exceed the target pixel intensity levels of the plurality of pixels if it is determined that the target pixel intensity levels cannot be reached in a given period of time.

2. The method of claim 1, wherein comparing the target picture frame with the current picture frame comprises performing a pixel-by-pixel comparison of the target picture frame and the current picture frame.

3. The method of claim 2, wherein determining adjustments to be made to the target picture frame comprises:

accessing a lookup table adapted to store pixel intensity levels corresponding to first pixel intensity levels for generating a first image on a display, second pixel intensity levels for generating a second image on the display, and overdrive pixel intensity levels for transitioning between the first and second pixel intensity levels;

comparing the pixel-by-pixel comparison of the target picture frame and the current picture frame with the first and second pixel intensity levels accessed in the lookup table; and retrieving the overdrive levels associated with any matches between the pixel-by-pixel comparison of the target picture frame and the current picture frame with the first and second pixel intensity levels.

4. The method of claim 3, wherein the adjustments determined to be made to the target picture comprise overdriving any pixel of the display that corresponds to a match between the pixel-by-pixel comparison of the target picture frame and the current picture frame with the first and second pixel intensity levels.

5. The method of claim 3, wherein the lookup table is adapted to store overdrive levels specific to the display.

6. The method of claim 3, wherein the lookup table is adapted to store overdrive levels for a plurality of displays.

7. The method of claim 3, wherein the lookup table is adapted to store overdrive levels for a generic display.

8. The method of claim 1, wherein the adjustments determined to be made to the target picture comprise overdriving select target pixel intensity levels to a specified higher level.

9. The method of claim 8, wherein the specified higher level corresponds an overdrive level related to any difference between the current pixel intensity level and the target pixel intensity level for any one of the plurality of pixels of the display.

10. The method of claim 1, comprising generating an achievable picture frame that corresponds to actual pixel intensity levels to be displayed on a display for each of the plurality of pixels of the display.

11. The method of claim 10, comprising replacing the current picture with the achievable picture frame.

12. The method of claim 1, comprising transmitting the adjusted picture frame to the display for generation of an image.

13. A method for displaying an image, comprising:

receiving a target picture frame comprising target pixel intensity levels corresponding to an image to be displayed;

comparing the target picture frame with a current picture frame comprising current pixel intensity levels corresponding to a displayed image;

determining if each of a plurality of pixels in a display is able to transition from the current pixel intensity levels to the target picture intensity levels in a specified time; and generating an adjusted pixel intensity level corresponding to each of the plurality of pixels of the display determined to be unable to transition from the current pixel intensity levels to the target picture intensity levels in the specified time, wherein the adjusted pixel intensity level comprises an overdrive level at an intensity level higher than the target pixel intensity level for each of the plurality of pixels in the display determined to be unable to transition from the current pixel intensity levels to the target picture intensity levels in the specified time.

14. The method of claim 13, wherein the overdrive level is based on pixel transitioning characteristics of the display.

15. The method of claim 13, comprising transmitting an adjusted picture frame to the display to generate an image, wherein the adjusted picture frame comprises the target picture frame overwritten by any adjusted pixel intensity levels.

16. The method of claim 13, wherein the specified time comprises the time required for the display to refresh each of the plurality of pixels of the display.

17. A signal adjusting circuit, comprising:

a lookup table adapted to store pixel intensity levels corresponding to first pixel intensity levels for generating a first image on a display, second pixel intensity levels for generating a second image on the display, and overdrive pixel intensity levels for transitioning between the first and second pixel intensity levels;

a buffer adapted to store a current picture frame that corresponds to current pixel intensity levels for each of a plurality of pixels of the display at a first time; and adjustment circuitry adapted to:

receive a target picture frame that corresponds to target pixel intensity levels for each of the plurality of pixels of the display at a second time; and modify the target picture frame to generate an adjusted picture frame containing adjustments to the target pixel intensity levels by overdriving pixels of the display to overdrive pixel intensity levels that exceed the target pixel intensity levels of the pixels if it is determined that the target pixel intensity levels of the pixels cannot be reached in a given period of time.

18. The signal adjusting circuit of claim 17, wherein the adjustment circuitry is adapted to actively retrieve the target picture frame.

19. The signal adjusting circuit of claim 17, wherein the adjustment circuitry is adapted to generate an achievable picture frame corresponding to actual pixel intensities generated on the display in conjunction with the adjusted picture frame.

20. The signal adjusting circuit of claim 19, wherein the adjustment circuitry is adapted to transmit the adjusted picture frame to a display for generation of an image.

21. The signal adjusting circuit of claim 19, wherein the adjustment circuitry is adapted to update the buffer with the achievable picture frame.

22. An electronic device, comprising:

a display comprising a plurality of pixels;

a buffer adapted to store a current picture frame that corresponds to current pixel intensity levels for each of the plurality of pixels of the display at a first time; and adjustment circuitry adapted to:

receive a target picture frame that corresponds to target pixel intensity levels for each of the plurality of pixels of the display at a second time;

calculate an adjusted picture frame containing adjustments to the target pixel intensity levels by determining pixel intensity levels corresponding to first pixel intensity levels for generating a first image on a display, determining second pixel intensity levels for generating a second image on the display, and determining overdrive pixel intensity levels for transitioning between the first and second pixel intensity levels; and modify the target picture frame to generate the adjusted picture frame containing adjustments to the target pixel intensity levels to overdrive pixels of the display to overdrive pixel intensity levels that exceed the target pixel intensity levels of the pixels if it is determined that the target pixel intensity levels of the pixels cannot be reached in a given period of time.

23. The signal adjusting circuit of claim 22, wherein the adjustment circuitry is adapted to generate an achievable picture frame corresponding to actual pixel intensities generated on the display in conjunction with the adjusted picture frame.

24. The signal adjusting circuit of claim 22, wherein the adjustment circuitry is adapted to transmit the adjusted picture frame to the display for generation of an image.

* * * * *